US010155138B2

(12) United States Patent
Mizutani

(10) Patent No.: US 10,155,138 B2
(45) Date of Patent: Dec. 18, 2018

(54) GOLF CLUB HEAD

(71) Applicant: SUMITOMO RUBBER INDUSTRIES, LTD., Kobe-shi (JP)

(72) Inventor: Naruhiro Mizutani, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/380,318

(22) Filed: Dec. 15, 2016

(65) Prior Publication Data

US 2017/0182379 A1 Jun. 29, 2017

(30) Foreign Application Priority Data

Dec. 26, 2015 (JP) ..... 2015-255456

(51) Int. Cl.
*A63B 53/04* (2015.01)

(52) U.S. Cl.
CPC .... *A63B 53/0466* (2013.01); *A63B 2053/042* (2013.01); *A63B 2053/045* (2013.01); *A63B 2053/0437* (2013.01)

(58) Field of Classification Search
USPC ..... 473/324–350
See application file for complete search history.

(56) References Cited

U.S. PATENT DOCUMENTS

| | | | | |
|---|---|---|---|---|
| 5,004,241 | A * | 4/1991 | Antonious | A63B 53/04 473/327 |
| 5,482,279 | A * | 1/1996 | Antonious | A63B 53/04 473/327 |
| 7,303,488 | B2 * | 12/2007 | Kakiuchi | A63B 53/0466 473/345 |
| 7,892,111 | B2 * | 2/2011 | Morales | A63B 53/0466 473/345 |
| 8,540,590 | B2 * | 9/2013 | Tsukada | A63B 53/0466 473/345 |
| 8,574,095 | B2 * | 11/2013 | Hirano | A63B 53/0466 473/329 |
| 9,174,100 | B2 * | 11/2015 | Takechi | A63B 53/0466 |
| 9,393,465 | B2 * | 7/2016 | Stokke | A63B 53/0466 |
| 9,468,818 | B2 * | 10/2016 | Nakamura | A63B 53/0466 |
| 9,522,310 | B2 * | 12/2016 | Abe | A63B 53/04 |
| 2014/0213389 | A1 * | 7/2014 | Yamamoto | A63B 53/0466 473/345 |
| 2015/0045147 | A1 * | 2/2015 | Abe | A63B 53/04 473/345 |

FOREIGN PATENT DOCUMENTS

| | | | | |
|---|---|---|---|---|
| JP | 10137372 | A * | 5/1998 | A63B 53/04 |
| JP | 2001104525 | A * | 4/2001 | |
| JP | 2001353240 | A * | 12/2001 | |
| JP | 2002058762 | A * | 2/2002 | |

(Continued)

*Primary Examiner* — Alvin Hunter
(74) *Attorney, Agent, or Firm* — Birch, Stewart, Kolasch & Birch, LLP

(57) ABSTRACT

The golf club head includes a crown portion, a face portion and a sole portion. The crown portion is formed to have an average thickness, in a range of a predetermined length toward a back side from a boundary between the crown portion and the face portion, that is larger in a vicinity of a center in a toe-heel direction than at a toe side and a heel side.

13 Claims, 6 Drawing Sheets

(56) References Cited

FOREIGN PATENT DOCUMENTS

| | | | | | |
|---|---|---|---|---|---|
| JP | 2003310806 | A | * | 11/2003 | |
| JP | 2004041376 | A | * | 2/2004 | |
| JP | 2004313354 | A | * | 11/2004 | |
| JP | 2005168665 | A | * | 6/2005 | ..... A63B 53/0466 |
| JP | 2005-312942 | A | | 11/2005 | |
| JP | 2005312942 | A | * | 11/2005 | |
| JP | 2009297047 | A | * | 12/2009 | ..... A63B 53/0466 |
| JP | 2011156073 | A | * | 8/2011 | |
| JP | 2012000161 | A | * | 1/2012 | ..... A63B 53/0466 |
| JP | 2013240404 | A | * | 12/2013 | |
| JP | 2014004096 | A | * | 1/2014 | |
| JP | 2014079397 | A | * | 5/2014 | ..... A63B 53/04 |

* cited by examiner

E1 Cross-section

GOLF CLUB HEAD

CROSS REFERENCE TO RELATED APPLICATION

This application claims a priority to Japanese Patent Application No. 2015-255456 filed on Dec. 26, 2015, which is hereby incorporated by reference in its entirety.

FIELD OF INVENTION

The present invention relates to a golf club head.

BACKGROUND OF THE INVENTION

The heads of wood-type golf clubs have undergone many improvements to date, and various proposals have been made particularly with regard to reducing the weight of the crown portion. For example, with a golf club head disclosed in JP 2005-312942A, a plurality of regions having a small thickness are formed in the crown portion, thereby achieving a reduction in the weight of the crown portion.

SUMMARY OF INVENTION

A first golf club head according to the present invention includes a crown portion, a face portion and a sole portion, the crown portion being formed to have an average thickness, in a range of a predetermined length toward a back side from a boundary between the crown portion and the face portion, that is larger in a vicinity of the center in a toe-heel direction than at a toe side and a heel side.

In the above golf club head, a configuration can be adopted in which the crown portion includes a thick region provided at least in a location extending from the toe side to the heel side along the boundary with the face portion and at least one thin region that is disposed further on the back side than the thick region and is smaller in thickness than the thick region, and the crown portion is formed such that a length of the thick region from the boundary in a face-back direction is greater in a vicinity of the center in the toe-heel direction than at the toe side and the heel side.

In the above golf club head, a configuration can be adopted in which the golf club head includes a plurality of the thin regions that are arranged side-by-side from the toe side to the heel side, and a distance between the boundary and the thin region disposed in a vicinity of the center in the toe-heel direction is longer than the distance between the boundary and the thin regions disposed on the toe side and the heel side.

In the above golf club head, a configuration can be adopted in which the crown portion includes a thick region provided at least in a location extending from the toe side to the heel side along the boundary with the face portion, and at least one thin region that is disposed further on the back side than the thick region and is smaller in thickness than the thick region, and the thin region is larger in thickness in a vicinity of the center in the toe-heel direction than on the toe side and the heel side.

In the above golf club head, a configuration can be adopted in which the golf club head includes a plurality of the thin regions that are arranged side-by-side from the toe side to the heel side, and the thin region disposed in a vicinity of the center in the toe-heel direction is larger in thickness than the thin regions disposed on the toe side and the heel side.

In each of the above golf club heads, a configuration can be adopted in which, in a peripheral portion of the crown portion, a lateral thick portion that is a part of the thick region is disposed on at least one of the toe side and the heel side relative to the thin region.

In the above golf club head, a configuration can be adopted in which the lateral thick portion is formed to have a length in the toe-heel direction that decreases moving toward the back side.

A second golf club head according to the present invention includes a crown portion, a face portion and a sole portion, the crown portion including a thick region provided at least in a location extending from the toe side to the heel side along a boundary with the face portion and at least one thin region that is disposed further on a back side than the thick region and is smaller in thickness than the thick region, and the crown portion being formed such that a length of the thick region from the boundary in a face-back direction is greater in a vicinity of the center in the toe-heel direction than at the toe side and the heel side.

A third golf club head according to the present invention includes a crown portion, a face portion and a sole portion, the crown portion including a thick region provided at least in a location extending from the toe side to the heel side along a boundary with the face portion and at least one thin region that is disposed further on a back side than the thick region and is smaller in thickness than the thick region, and the thin region is larger in thickness in a vicinity of the center in the toe-heel direction than at the toe side and the heel side.

According to an one aspect of embodiment, in the crown portion, the average thickness, in a range of a predetermined length toward the back side from the boundary, is larger in a vicinity of a center in the toe-heel direction than at the toe side and the heel side. Thus, even though the rebound performance generally falls at locations that areaway from the center of gravity, the rebound performance can be improved, since the average of thicknesses is smaller at the toe side and heel side which are away from the center of gravity. On the other hand, since improvement in rebound performance in a vicinity of the center in the toe-heel direction where the center of gravity is located is suppressed, the rules can be observed. Therefore, the rebound performance of the face portion as a whole, spanning from the toe side to the heel side, can be improved.

DETAILED DESCRIPTION OF THE PREFERRED EMBODIMENTS

Rebound tends to be highest near the center of gravity, and thus when the thickness of regions of the crown portion near where the center of gravity is projected (hereinafter, location of the center of gravity) is reduced, rebound performance could be too high, and possibly infringe the rules. Also, generally, rebound tends to decrease moving away from the location of the center of gravity.

The embodiments are made in order to solve the above problems, and an object is to provide a golf club head that helps to improve rebound performance at locations away from the location of the center of gravity, while suppressing rebound performance at the location of the center of gravity.

A. First Embodiment

A first embodiment of a golf club head according to the present invention will be described below, with reference to the drawings.

1. Outline of Golf Club Head

Figure 1:
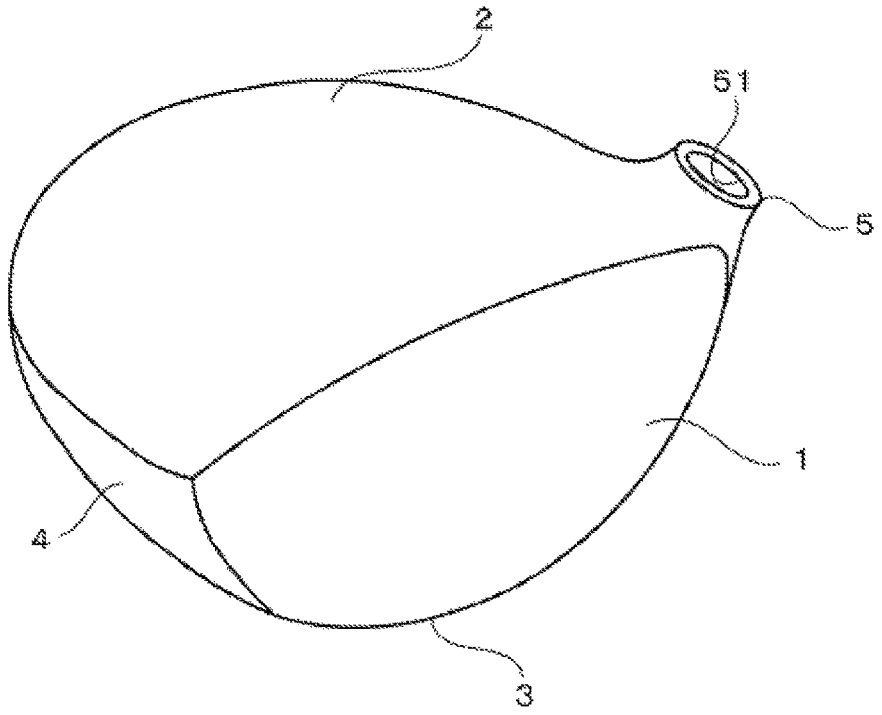
FIG. 1 is a perspective view of the reference state of a golf club head according to one embodiment.

As shown in FIG. 1, the golf club head (hereinafter, may simply be referred to as the "head") according to the present embodiment is a hollow structure, and a wall surface is formed by a face portion 1, a crown portion 2, a sole portion 3, aside portion 4, and a hosel portion 5.

The face portion 1 has a face surface, which is the surface that strikes the ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is a region between the crown portion 2 and the sole portion 3, and extends from the toe side of the face portion 1 to the heel side of the face portion 1 around the back side of the head. Furthermore, the hosel portion 5 is a region that is provided adjacent to the heel side of the crown portion 2, and has an insertion hole 51 into which the shaft (illustration omitted) of the golf club is inserted. A center axis Z of this insertion hole 51 coincides with the axis of the shaft. Although the head that is described here is a wood-type head such as a driver (1 wood) or a fairway wood, the type of head is not limited, and may be a so-called utility-type head, hybrid-type head, or the like.

Figure 2:
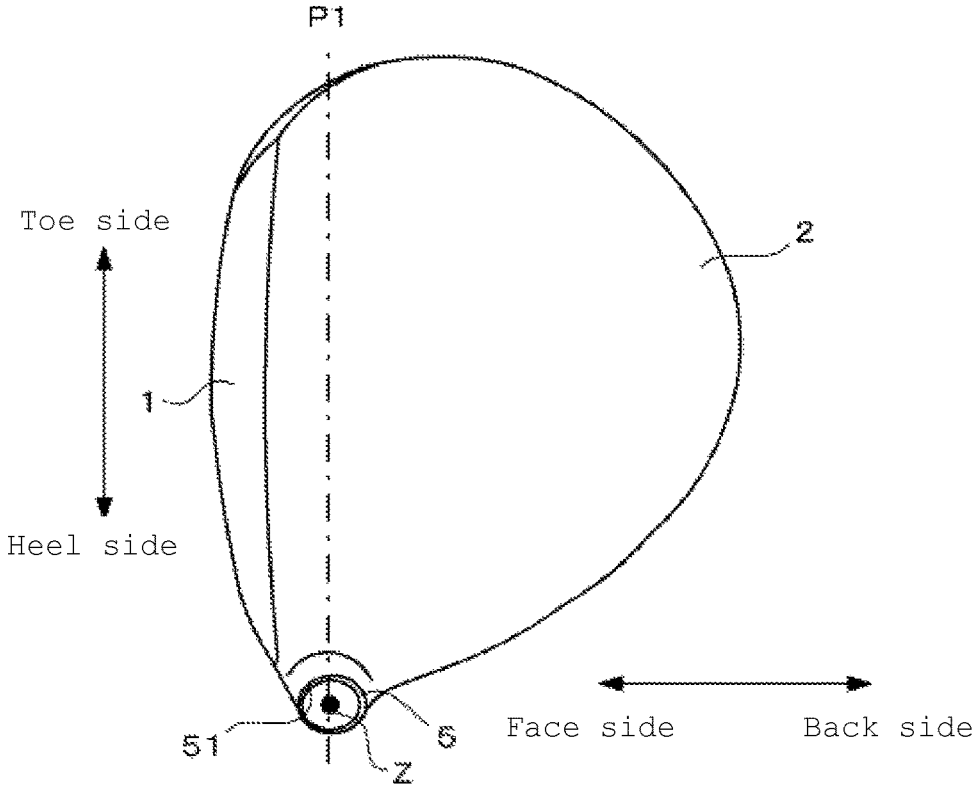
FIG. 2 is a plan view of FIG. 1.

Here, the abovementioned reference state will be described. First, as shown in FIGS. 1 and 2, a state in which the center axis Z is included in a perpendicular plane P1 relative to a horizontal plane and the head is placed on the horizontal plane at a predetermined lie angle and real loft angle is prescribed as the reference state. The plane P1 is referred to as a reference perpendicular plane P1. Also, as shown in FIG. 2, the direction of the line of intersection of the reference perpendicular plane P1 and the horizontal plane will be referred to as the toe-heel direction, and the direction that is perpendicular to this toe-heel direction and parallel to the horizontal plane will be referred to as the face-back direction.

Figure 3A:
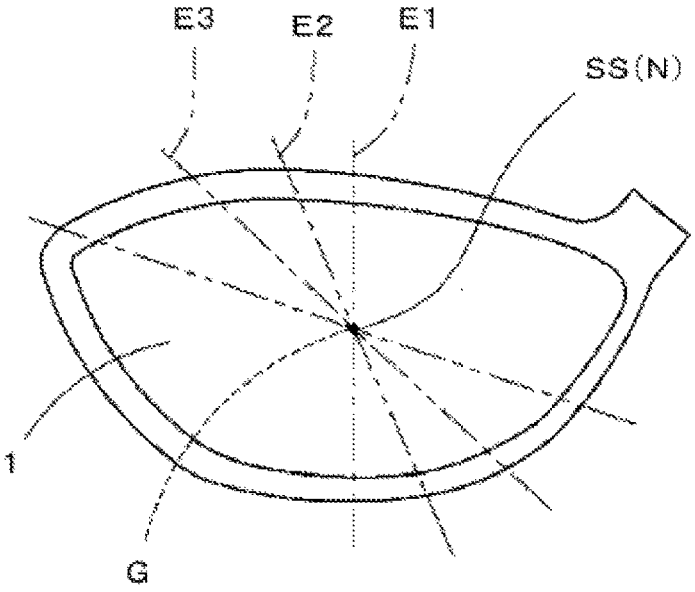
FIGS. 3A and 3B are diagrams illustrating a boundary of a face portion.
Figure 3B:
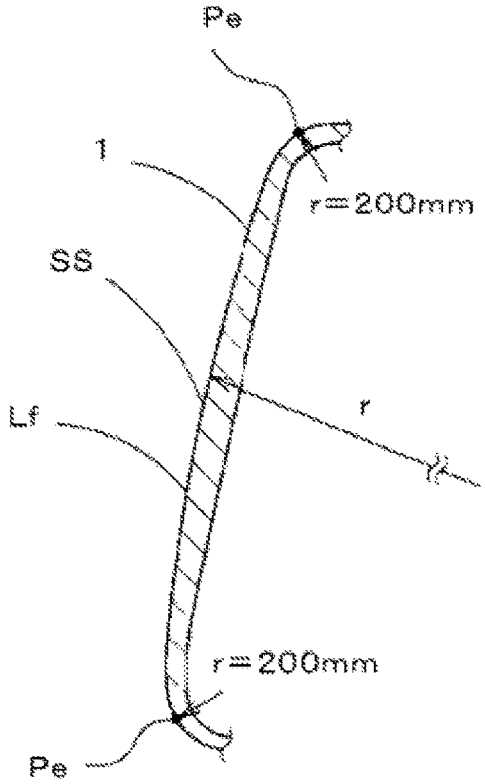

In the present embodiment, the boundary between the crown portion 2 and the side portion 4 can be defined as follows. That is, in the case where a ridgeline is formed between the crown portion 2 and the side portion 4, this ridgeline will be the boundary. In contrast, in the case where a clear ridgeline is not formed, the profile seen when the head is placed in the reference state and viewed from directly above the center of gravity of the head will be the boundary. The same also applies to the boundary of the face portion 1 with the crown portion 2 and the sole portion 3, and in the case where a ridgeline is formed, this ridgeline will be the boundary. On the other hand, in the case where a clear ridgeline is not formed, positions Pe where, in each of cross-sections E1, E2, E3 and so on that include a straight line N connecting a center of gravity G of the head and a sweet spot SS, as shown in FIG. 3A, a radius of curvature r of a profile line Lf of a face outer surface first reaches 200 mm in a direction toward the face outer side from the sweet spot side, as shown in FIG. 3B, is defined as the periphery (boundary) of the face portion 1. Note that the sweet spot SS is the intersection of the normal (straight line N) of the face surface that passes through the center of gravity G of the head and this face surface.

Also, in the present embodiment, the boundary between the sole portion 3 and the face portion 1 and between the sole portion 3 and the side portion 4 can be defined as follows. That is, in the case where a ridgeline is formed between the sole portion 3 and the face portion 1 and between the sole portion 3 and the side portion 4, this ridgeline will be the boundary. Also, the golf club head according to the present embodiment has the side portion 4, but in the case where, for example, a side portion is not provided, or where the side portion 4 is included in the sole portion 3 without being clearly distinguishable, or where the sole portion 3 is directly connected to the crown portion 2, the ridgeline between the sole portion 3 and the crown portion 2 will be the boundary between the two portions. Also, in the case where a clear ridgeline is not formed, the profile seen when the head is placed in the reference state and viewed from directly above the center of gravity of the head will be the boundary.

The volume of this golf club head is, for example, preferably 300 $cm^3$ or greater, more preferably 400 $cm^3$ or greater, and particularly preferably 420 $cm^3$ or greater. A head having such a volume helps to make the golfer feel more confident when addressing the ball, and also helps to increase the sweet area and the moment of inertia. Note that the upper limit of the head volume is not particularly determined, although 500 $cm^3$ or less, for example, is desirable in terms of actual use, and 470 $cm^3$ or less is desirable in the case of complying with the rules and regulations of the R&A and the USGA.

Also, the head can, for example, be formed with a titanium alloy (Ti-6Al-4V) having a specific gravity substantially around 4.4 to 4.5. Apart from a titanium alloy, the head can also be formed using one or a plurality of materials selected from a group including stainless steel, maraging steel, an aluminum alloy, a magnesium alloy and an amorphous alloy. Such a golf club head can be produced with various methods, and can, for example, be manufactured by casting such as well-known lost-wax precision casting.

Also, with the golf club head according to the present embodiment, the position of the center of gravity is disposed in a vicinity of the center of the head in the toe-heel direction.

2. Assembly Structure of Golf Club Head

Figure 4:
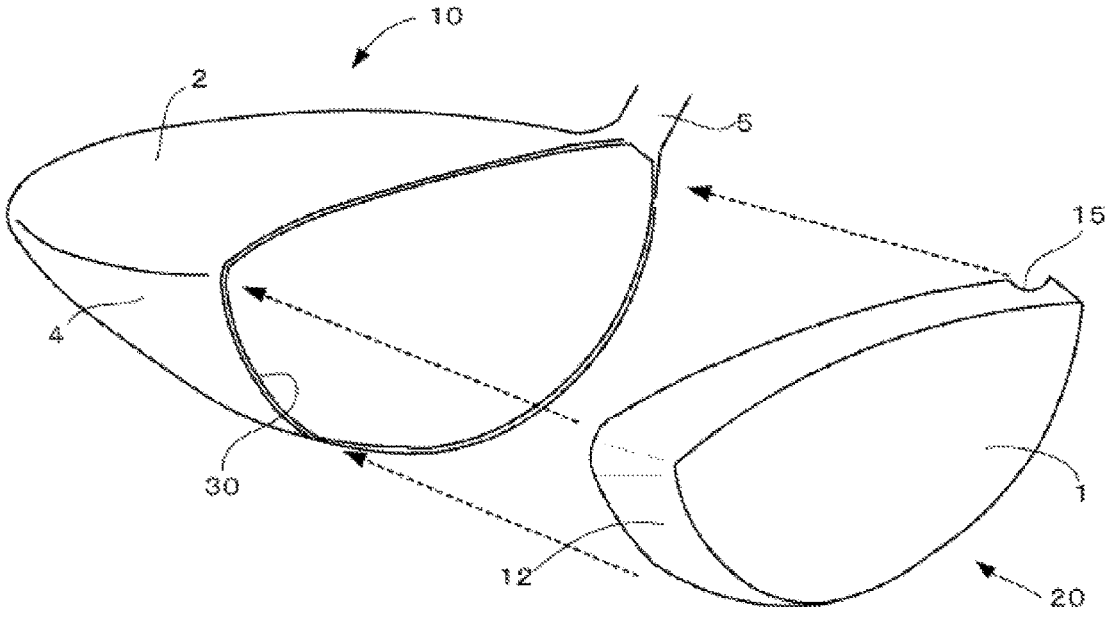
FIG. 4 is a perspective view showing the assembly of a golf club head according to a first embodiment.

The golf club head according to the present embodiment is constituted, as shown in FIG. 4, by assembling a head main body 10 having the crown portion 2, the sole portion 3 and the side portion 4, and a face member 20 formed in a cup shape having the face portion 1 and a peripheral portion 12 extending from the periphery of the face portion 1. This head main body 10 has an opening 30 surrounded by the crown portion 2, the sole portion 3 and the side portion 4, and the face member 20 is attached so as to close this opening 30. That is, the end surface of the peripheral portion 12 of the face member 20 is butted against the end surface of the opening 30, and these portions are joined by welding. The face member 20 is then integrated with the head main body 10 by being attached to the opening of the head main body 10, and the peripheral portion 12 of the face member 20 thereby functions as a part of crown portion 2, sole portion 3 and side portion 4. Accordingly, the surface that is integrally formed by the peripheral portion 12 of the face member 20 being attached to the head main body 10 constitutes the crown portion 2, the sole portion 3 and the side portion 4. Thus, although the respective portions of the head main body 10 are, strictly speaking, a part of the crown, sole and side portions, the respective portions of the head main body 10 may, hereinafter, also be referred to as the crown portion 2, the sole portion 3 and the side portion 4, without making this distinction.

3. Structure of Crown Portion

Figure 5:
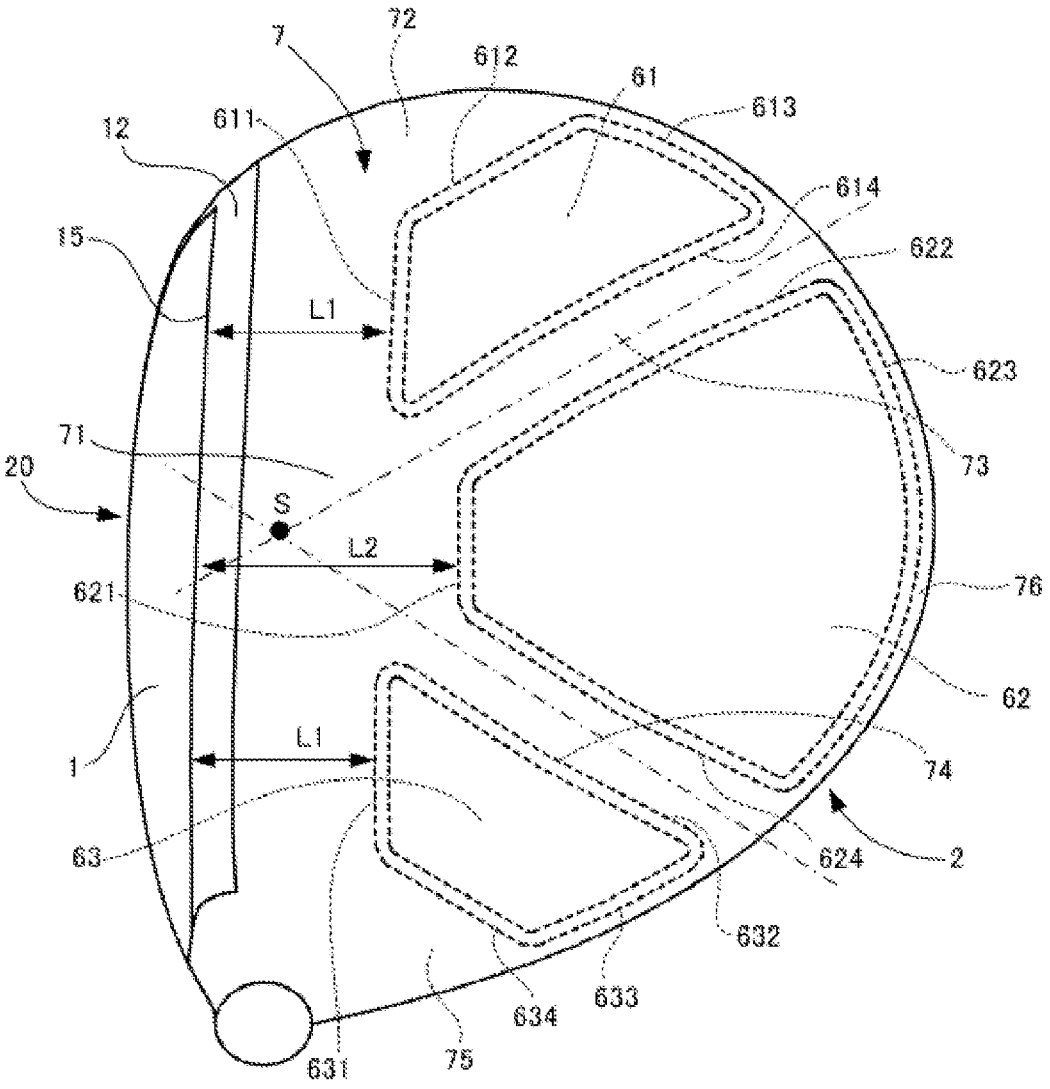
FIG. 5 is a plan view of the golf club head according to the first embodiment.

Next, the crown portion 2 will be described, with reference also to FIG. 5. FIG. 5 is a plan view of the golf club head, and, in particular, the regions having different thicknesses in the crown portion 2 (thin regions will be discussed later) are clearly shown with dashed lines. As shown in FIG. 5, the crown portion 2 is constituted by a thick region 7 where the thickness is large, and a plurality (three in the present embodiment) of thin regions 61 to 63 where the thickness is small. Each of the thin regions 61 to 63 is configured to have a small thickness by forming recessed portions in the inner wall surface (surface on the interior space side) of the crown portion 2. Hereinafter, the three thin regions that are arranged side-by-side from the toe side to the heel side will be referred to as a first thin region 61, a second thin region 62 and a third thin region 63. These regions will be described below in detail.

The first thin region 61 is formed in a rectangular shape, and is provided with a first side 611 extending substantially parallel to a boundary 15 (hereinafter, simply referred to as the boundary) between the face portion 1 and the peripheral portion 12 of the face member 20 in the toe-heel direction, a second side 612 facing the toe side, a third side 613 extending along the boundary between the crown portion 2 and the side portion 4 at the back side, and a fourth side 614 facing the heel side. In other words, the first thin region 61 is formed to have a trapezoidal shape in which the fourth side 614 is longer than the second side 612. Also, the first side 611 is formed at a distance L1 toward the back side from the boundary 15. Hereinafter, the portion of the thick region 7 that is formed between the boundary 15 and the thin regions 61 to 63 will be referred to as a face-side thick portion 71.

Also, the second side 612 of the first thin region 61 is formed so as to extend toward the back side obliquely to the toe side. That is, the intersection of the first side 611 and the second side 612 is formed in a position at a predetermined distance from the end edge of the crown portion 2 on the toe side, and the second side 612 is configured to approach the end edge of the crown portion 2 on the toe side moving toward the back side. The portion of the thick region 7 that is disposed further on the toe side than the first thin region 61 is thereby formed in a triangular shape in plan view. This portion will be referred to below as a toe-side thick portion (lateral thick portion) 72.

The third side 613 of the first thin region 61 extends in an arc along the boundary between the crown portion 2 and the side portion 4 from the end of the second side 612 on the back side. The fourth side 614 is formed in a linear shape so as to connect the third side 613 and the first side 611. That is, the fourth side 614 slopes so as to approach the heel side moving toward the face side, from the intersection with the third side 613. These sides 611 to 614 constituting the periphery of the first thin region 61 may, however, be formed in a curved shape. Note that this point also similarly applies to the sides of the second and third thin regions 62 and 63 which will be discussed below.

Next, the second thin region 62 will be described. The second thin region 62 is also formed in a generally rectangular shape (or fan shape) composed of four sides, and is provided with a first side 621 extending substantially parallel to the boundary 15, a second side 622 extending parallel to the fourth side 614 of the first thin region 61, a third side 623 extending along the boundary between the crown portion 2 and the side portion 4 at back side, and a fourth side 624 facing the heel side. The first side 621 is formed to be slightly shorter than the first side 611 of the first thin region 61, and is formed at a distance L2, which is longer than the distance L1, toward the back side from the boundary 15. The second side 622 extends parallel to the fourth side 614 of the first thin region 61, and a thick region is formed between both sides. This thick region will be referred to as a first gap thick portion 73.

The third side 623 of the second thin region 62 extends in an arc along the boundary between the crown portion 2 and the side portion 4, from the end of the second side 622 on the back side. This third side 623 is formed so as to pass through generally a vicinity of the middle of the crown portion 2 in the toe-heel direction, and to extend generally equally on the toe side and the heel side from the vicinity of the middle. The fourth side 624 is formed in a linear shape, so as to connect the third side 623 and the first side 621. That is, the fourth side 624 slopes so as to approach the toe side moving toward the face side, from the intersection with the third side 623.

Next, the third thin region 63 will be described. The third thin region 63 is also formed in a generally rectangular shape, and is provided with a first side 631 extending substantially parallel to the boundary 15, a second side 632 extending parallel to the fourth side 624 of the second thin region 62, a third side 633 extending along the boundary between the crown portion 2 and the side portion 4 at the back side, and a fourth side 634 facing the heel side. In other words, the third thin region 63 is formed to have a trapezoidal shape in which the second side 632 is longer than the fourth side 634. Also, the first side 631 is formed to be generally the same length as the first side 611 of the first thin region 61, and is formed at the same distance L1 as the first thin region toward the back side from the boundary 15. The second side 632 extends parallel to the fourth side 624 of the second thin region 62, and a thick region is formed between both sides. This thick region will be referred to as a second gap thick portion 74. Note that an intersection S of a virtual line passing through the center of the first gap thick portion 73 and a virtual line passing through the center of the second gap thick portion 74 is located in the face-side thick portion 71.

The third side 633 of the third thin region 63 extends in an arc along the boundary between the crown portion 2 and the side portion 4 from the end of the second side 632 on the back side. The fourth side 634 is formed in a linear shape so as to connect the third side 633 and the first side 631. To describe in more detail, the intersection of the first side 631 and the fourth side 634 is formed in a position at a predetermined distance from the end edge of the crown portion 2 on the heel side, and the fourth side 634 is configured to approach the end edge of the crown portion 2 on the heel side moving toward the back side. The portion of the thick region that is disposed further on the heel side than the third thin region 63 is thereby formed in a triangular shape in plan view. This portion will be referred to below as a heel-side thick portion (lateral thick portion) 75.

Also, a thick region having a narrow width is formed between the third sides 613, 623 and 633 of the thin regions 61 to 63 and the boundary between the crown portion 2 and the side portion 4. This region will be referred to below as a peripheral thick portion 76.

As described above, each of the thin regions 61 to 63 is formed at a distance from the boundary 15 between the peripheral portion 12 of the face member 20 and the crown portion 2, with that distance being shorter at the first thin region 61 and the third thin region 63 and being longer at the second thin region 62. For example, the distance L1 between the first side 611 of the first thin region 61 and the boundary 15 is preferably 5 to 25 mm. Also, the distance L2 between the first side 621 of the second thin region 62 and the boundary 15 is preferably 20 to 40 mm.

Also, the width of the first and second gap thick portions 73 and 74 can be set from 5 to 15 mm, for example. Furthermore, the width of the peripheral thick portion 76 can be set from 2 to 20 mm, for example.

In the crown portion 2, the thickness of the thick region 7 can be set from 0.5 to 0.8 mm, for example, and the thickness of each of the thin regions 61 to 63 can be set from 0.3 to 0.6 mm. Note that a step can be formed between each of the thin regions 61 to 63 and the thick region 7, or alternatively a transition portion whose thickness changes can also be provided on the periphery of each of the thin regions 61 to 63. That is, a configuration can be adopted in which the thickness gradually increases toward the thick region 7 from the thin regions 61 to 63. The width of such a transition portion can be set from 0.5 to 10 mm, for example. In FIG. 5, as an example, each of the thin regions 61 to 63 are indicated with a double dashed line, and the space between an inner dashed line and outer dashed line can be taken as the transition portion. That is, a configuration can be adopted in which the thickness increases from the inner dashed line to the outer dashed line.

Also, in the plan view of the head shown in FIG. 5, a percentage R (=S1/S2) that a projected area S1 of all the thin regions 61 to 63 occupies in an area S2, which is the sum total of the projected area of the crown portion 2 and the projected area of the hosel portion 5, is 25 to 70%. When this percentage R is smaller than 25%, it becomes difficult to create surplus weight to shift to other regions (e.g., sole portion 3, etc.). Thus, the percentage R is more preferably 30% or greater, and particularly preferably 40% or greater. On the other hand, castability decreases when the percentage R is larger than 70%. Thus, the percentage R is preferably 65% or less, and particularly preferably 60% or less. For example, in the case of a driver, the area S2 will be around 80 to 120 $cm^2$.

4. Manufacturing Method

The golf club head constituted as described above can be produced with various methods, and can, for example, be manufactured as follows. First, the head main body 10 can be manufactured by casting such as well-known lost-wax precision casting, for example. On the other hand, the face member 20 can be manufactured by pressing. The head main body 10 and the face member 20 are then joined by welding, for example. Thereafter, the golf club head is completed by processes such as painting.

5. Features

According to the above embodiment, the following effects can be obtained.

(1) The distance from the boundary 15 between the face member 20 and the crown portion 2 to each of the thin regions 61 to 63 is largest at the second thin region 62, and shorter at the first and third thin regions 61 and 63. In the crown portion 2 according to the present embodiment, the average of thicknesses, in a range of a predetermined length toward the back side from the boundary 15 (e.g., a range of 5 to 25 mm contributing to rebound (deformation), with a range of 10 to 20 mm contributing further), is thereby larger in a vicinity of the center in the toe-heel direction and smaller at the toe side and the heel side. Thus, since an increase in the rebound performance in a vicinity of the center in the toe-heel direction where the center of gravity is positioned can be suppressed, the rules can be observed. On the other hand, even though the rebound performance generally falls at locations that are away from the center of gravity, the rebound performance can be improved in the present embodiment, since the average of thicknesses is smaller at the toe side and the heel side. Therefore, the rebound performance of the face portion as a whole, spanning from the toe side to the heel side, can be improved.

(2) Since the first and second gap thick portions 73 and 74 extending in the face-back direction are formed between the adjacent thin regions 61 to 63, a certain amount of rigidity can be given to the thin regions 61 to 63, thereby preventing a fall in rebound performance. Also, pouring of molten metal can be facilitated when casting is performed, since the channel for the molten metal is enlarged as a result of forming the gap thick portions 73 and 74.

(3) The weight removed as a result of forming the three thin regions 61 to 63 can be moved to regions such as the sole portion 3, thereby enabling the center of gravity of the head to be lowered.

(4) The toe-side thick portion 72 and the heel-side thick portion 75 are respectively formed on the toe side of the first thin region 61 and the heel side of the third thin region 63. These regions are polished after molding, since the sprue at the time of casting is disposed therein. Also, these regions are close to the peripheral portion of the face member that undergoes welding. Accordingly, the thickness may be unintentionally reduced in these regions due to polishing or the like, thereby possibly resulting in cracking. Thus, cracking can be prevented by increasing the thickness of these regions. Also, these thick portions 72 and 75 decrease in width in the toe-heel direction moving toward the back side. That is, the width is increased on the face side where strength is required, and the width is smaller on the back side where not much strength is required, thereby enabling the area of the thin regions on the back side to be increased. As a result, that thickness can be moved to the sole portion 3 side, for example.

6. Variations

Although one embodiment of the present invention has been described above, the present invention is not limited to the foregoing embodiment, and various modifications that do not depart from the gist of the invention can be made. Note that the following variations can be combined as appropriate.

Figure 6:
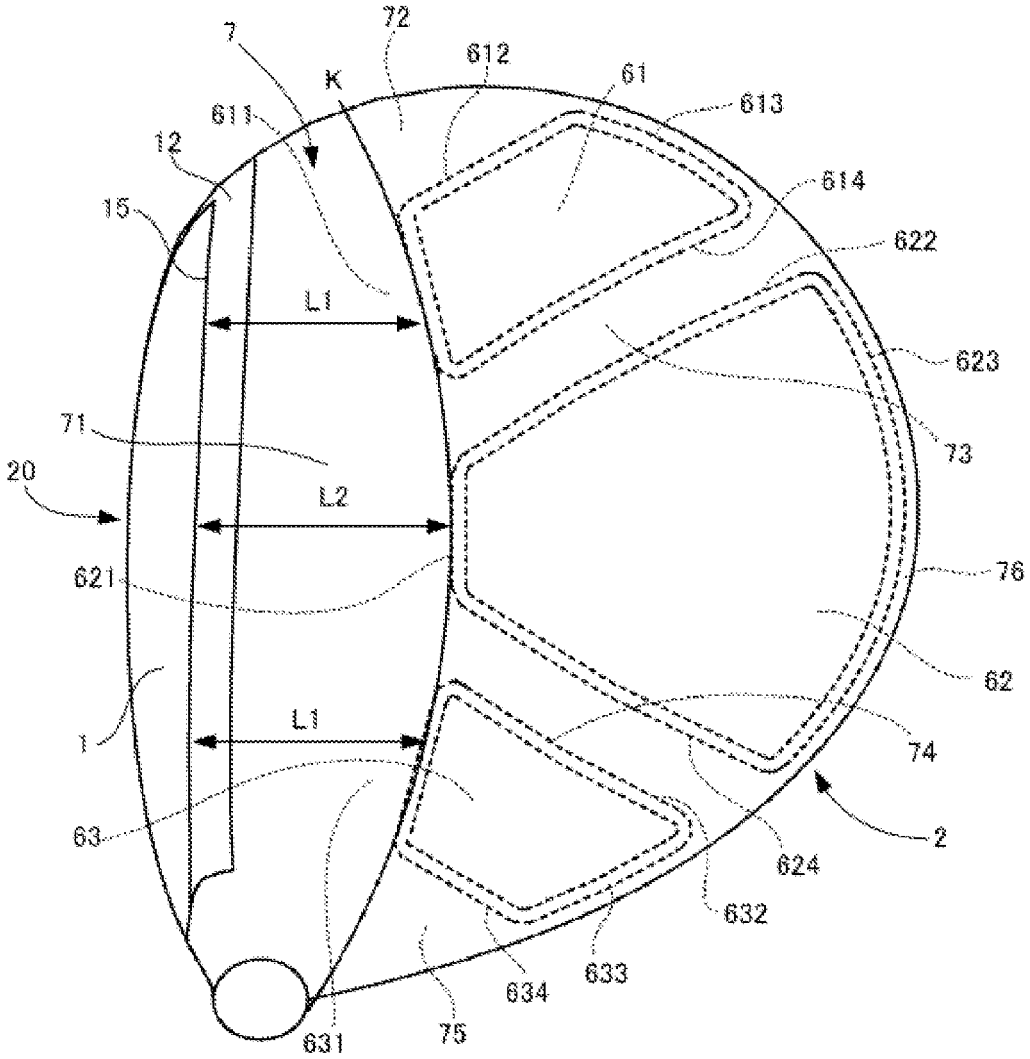
FIG. 6 is a plan view showing another example of the golf club head according to the first embodiment.

(1) In the above embodiment, the number of thin regions 61 to 63 is given as three, but the present invention is not limited thereto, and a configuration can also be adopted in which the number of thin regions is two or less or is four or more. In the case of dividing the thin regions 61 to 63 into a plurality of regions, the gap thick portions 73 and 74 therebetween are not particularly limited in shape. The thin regions 61 to 63 are also not particularly limited in shape, and need only at least be formed such that the distance from the boundary 15 is longer in a vicinity of the center in the toe-heel direction (region including the location where the center of gravity is projected). From this viewpoint, each of the thin regions 61 to 63 can also be formed as follows. For example, as shown in FIG. 6, a virtual line K that extends along the boundary 15 and is curved such that the distance from the boundary 15 is longer in a vicinity of the center in the toe-heel direction and shorter at the toe side and the heel side is formed. The first sides 611, 621 and 631 of the thin regions 61 to 63 are formed so as to be disposed on this virtual line K. Similar effects to the above embodiment can thereby also be obtained. Note that the virtual line K may be a straight line. For example, the first side 621 of the second thin region 62 is a straight line parallel to the boundary 15, but may be a curved line (convex or concave on the face side, or wavy) or a folded line (V-shaped, W-shaped, etc.).

Also, the first sides 611, 621 and 631 of the thin regions 61 to 63 can be made into various shapes, such as being a combination of a parallel line parallel to the boundary 15 and a virtual line K such as shown in FIG. 6, or having a plurality of steps or a curve. That is, the distance between the thin regions 61 to 63 and the boundary 15 need only be formed so as to become shorter, as a whole, moving toward the toe side and the heel side.

(2) The back side of each of the thin regions 61 to 63 does not necessarily need to be close to the periphery of the back side of the crown portion 2 (boundary with the side portion 4), and is also not particularly limited in shape. Also, although the shape of the toe-side thick portion 72 and the heel-side thick portion 75 need not be triangular, the width in the toe-heel direction preferably decreases moving toward the back side. A configuration can also be adopted in which the toe-side thick portion 72 and the heel-side thick portion 75 are not provided.

(3) The thickness distribution of the region from the boundary 15 between the face member 20 and the crown portion 2 to the first sides 611, 621 and 631 of the thin regions 61 to 63, or in other words, the face-side thick portion 71, is not particularly limited. For example, the thickness may be constant from the boundary 15 to each of the thin regions 61 to 63, or a configuration can also be adopted in which, for example, the thickness decreases moving toward the back side.

(4) The mode of the golf club according to the embodiment is one example, and as long as the crown portion 2 is configured as described above, the other configuration is not particularly limited. For example, with the above golf club, the cup-like face member 20 is joined to the opening of the head main body 10, but the golf club head can also be constituted by fitting a plate-like face portion into the opening of the head main body. Also, a configuration may be adopted in which an opening is formed in the crown portion 2 and this opening is closed with a plate.

(5) The present invention can be applied to golf club heads such as drivers, fairway woods, and utilities.

B. Second Embodiment

A second embodiment of the golf club head according to the present invention will be described below, with reference to the drawings.

1. Configuration of Crown Portion

Since the second embodiment differs from the first embodiment in the configuration of the crown portion and the other configuration is the same, only the differences will be described. Accordingly, corresponding configuration will be described using the same names and will be given the same reference numerals.

Figure 7:
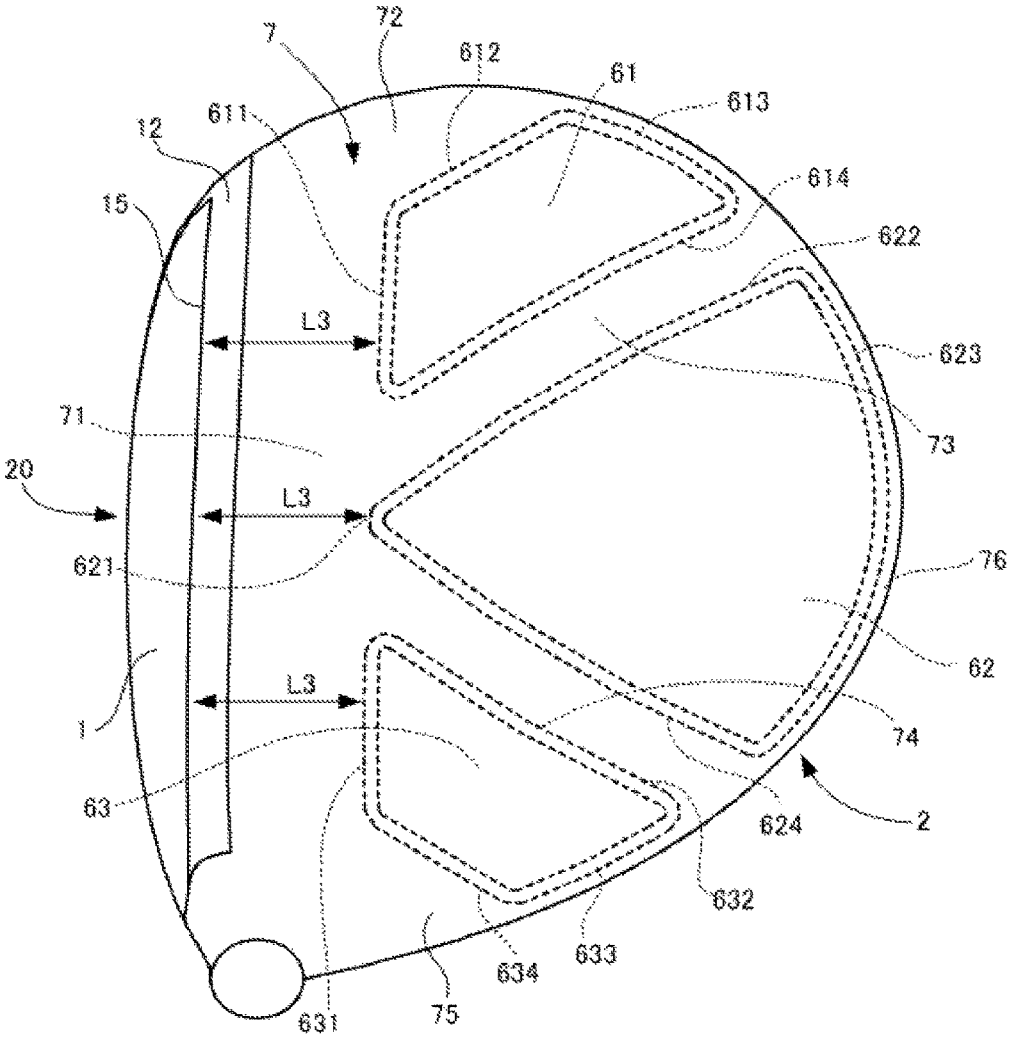
FIG. 7 is a plan view showing a golf club head according to a second embodiment.

As shown in FIG. 7, in the second embodiment, the crown portion has a thick region 7 and three thin regions 61 to 63, similarly to the first embodiment, but differs in the following respects. First, although the first sides 611, 621 and 631 of the thin regions 61 to 63 extend parallel to the boundary 15 between the face member 20 and the crown portion 2, a distance L3 (e.g., 5 to 40 mm) from the boundary 15 is the same. Next, the thicknesses of each of the thin regions 61 to 63 are different, with the thickness of the second thin region 62 being larger, and the thicknesses of the first and third thin regions 61 and 63 being smaller. Even the second thin region 62 having the largest thickness, however, has a smaller thickness than the thick region 7.

The thickness of the second thin region 62 can be set from 0.35 to 0.6 mm, for example, and the thicknesses of the first and third thin regions 61 and 63 can be set from 0.3 to 0.6 mm, for example. The thicknesses of the first and third thin regions 61 and 63, however, need not be completely the same, and need only at least be smaller than the second thin region 62.

2. Features

According to the above configuration, the thicknesses of the three thin regions 61 to 63 are different, with the thickness of the second thin region 62 that is disposed in a vicinity of the middle in the toe-heel direction being formed to be the largest. Thus, improvement in the rebound performance in a vicinity of the middle can be suppressed, and the rebound performance on the toe side and the heel side can be increased. As a result, similarly to the first embodiment, the average of thicknesses, in a range of a predetermined length toward the back side from the boundary 15 (e.g., a range of 5 to 25 mm contributing to rebound (deformation), with a range of 10 to 20 mm contributing further), is larger in a vicinity of the middle and smaller at the toe side and the heel side. Thus, since improvement in the rebound performance in a vicinity of the middle where the center of gravity is positioned can be suppressed, the rules can be observed. On the other hand, since the average of thicknesses at the toe side and heel side which are away from the center of gravity is smaller, the rebound performance can be improved despite being away from the center of gravity. Therefore, the rebound performance of the face portion as a whole, spanning from the toe side to the heel side, can be improved.

3. Variations (1) In the above embodiment, the number of the thin regions 61 to 63 is given as three, but the present invention is not limited thereto, and a configuration can also be adopted in which the number of thin regions is two or less or is four or more. In the case of dividing the thin regions 61 to 63 into a plurality of regions, the gap thick portions 73 and 74 therebetween are not particularly limited in shape. The thin regions 61 to 63 are also not particularly limited in shape, and the thin region that is disposed in a vicinity of the center in the toe-heel direction (region including the place where the center of gravity is projected) need only have a larger thickness. Also, apart from making the thicknesses within each of the thin regions 61 to 63 constant, the thicknesses may be changed within each of the thin regions 61 to 63. That is, a configuration may be adopted in which the thickness increases within each of the thin regions 61 to 63 moving toward the center side. For example, a configuration can also be adopted in which only one thin region is formed, and the thickness increases moving toward the center side. Also, thin regions having a constant thickness and thin regions having different thicknesses can also be mixed.

(2) Variations (2) to (5) shown in the abovementioned first embodiment can also be similarly applied in the second embodiment. The configurations of the first embodiment and the second embodiment can also be mixed. That is, a configuration can be adopted in which the distance between the boundary 15 and each of the thin regions 61 to 63 changes, and the crown portion may be formed such that the thickness of each of the thin regions 61 to 63 changes.

REFERENCE SIGNS LIST

1 Face portion
2 Crown portion
5 Side portion
61 First thin region
62 Second thin region
63 Third thin region
7 Thick region
72 Toe-side thick portion (lateral thick portion)
75 Heel-side thick portion (lateral thick portion)

The invention claimed is:

1. A golf club head comprising:
a crown portion;
a face portion; and
a sole portion,
wherein the crown portion includes:
a thick region provided at least in a location extending substantially entirely from a toe side to a heel side along a boundary with the face portion; and
at least one thin region that is disposed further on a back side than the thick region and is smaller in thickness than the thick region,
wherein a length of the thick region from the boundary in a face-back direction is greater in a vicinity of a center in a toe-heel direction than at the toe side and the heel side,
wherein, in a peripheral portion of the crown portion, a lateral thick portion that is a part of the thick region is disposed on at least one of the toe side and the heel side relative to the at least one thin region, and
wherein the lateral thick portion is formed to have a length in the toe-heel direction that decreases moving toward the back side.

2. The golf club head according to claim 1, further comprising a hosel portion, wherein a percentage R (=S1/S2) that a projected area S1 of the at least one thin region occupies in an area S2, which is a sum total of a projected area of the crown portion and a projected area of the hosel portion, is 25 to 70%.

3. The golf club head according to claim 1, further comprising:
a plurality of thin regions that are arranged side-by-side from the toe side to the heel side,
wherein a distance between the boundary and a thin region disposed in a vicinity of the center in the toe-heel direction is longer than a distance between the boundary and thin regions disposed on the toe side and the heel side.

4. The golf club head according to claim 3, wherein the crown portion is provided with a gap thick portion disposed between each of the plurality of thin regions.

5. The golf club head according to claim 4, wherein the plurality of thin regions includes a first thin region, a second thin region and a third thin region, and
wherein the first thin region is disposed at the toe side of the crown portion, the second thin region is adjacent to the first thin region and disposed at a middle of the crown portion, and the third thin region is adjacent to the second thin region and disposed at the heel side of the crown portion.

6. The golf club head according to claim 5, wherein the second thin region is formed in a fan shape that expands toward the back side from a face side.

7. The golf club head according to claim 1, wherein the crown portion is provided with a gap thick portion disposed between each of the thin regions.

8. The golf club head according to claim 7, wherein the plurality of thin regions includes a first thin region, a second thin region and a third thin region, and
wherein the first thin region is disposed at the toe side of the crown portion, the second thin region is adjacent to the first thin region and disposed at the middle of the crown portion, and the third thin region is adjacent to the second thin region and disposed at the heel side of the crown portion.

9. The golf club head according to claim 8, wherein the second thin region is formed in a fan shape that expands toward the back side from a face side.

10. The golf club head according to claim 1, wherein a boundary of the thick region with the at least one thin region extends in the toe-heel direction.

11. The golf club head comprising:
a crown portion;
a face portion; and
a sole portion,
wherein the crown portion includes:
a thick region provided at least in a location extending substantially entirely from a toe side to a heel side along a boundary with the face portion; and
a plurality of thin regions that are disposed further on a back side than the thick region and are thinner than the thick region,
wherein the plurality of thin regions are arranged side-by-side from the toe side to the heel side, and
wherein a thin region disposed in a vicinity of a center in a toe-heel direction is larger in thickness than thin regions disposed on the toe side and the heel side.

12. The golf club head according to claim 11, further comprising a hosel portion, wherein a percentage R (=S1/S2) that a projected area S1 of the thin region occupies in an area S2, which is a sum total of a projected area of the crown portion and a projected area of the hosel portion, is 25 to 70%.

13. The golf club head according to claim 11, wherein a boundary of the thick region with the at least one thin region extends in the toe-heel direction.

* * * * *